US007591631B2

(12) United States Patent
Hendricks et al.

(10) Patent No.: US 7,591,631 B2
(45) Date of Patent: Sep. 22, 2009

(54) FLOW DELIVERY SYSTEM FOR SEALS

(75) Inventors: Gavin Hendricks, Manchester, CT (US); Nils G. Dahl, Stonington, CT (US); Kevin M. Plante, Coventry, CT (US); Charles C. Wu, Glastonbury, CT (US); Christopher J. Loconto, Worcester, MA (US)

(73) Assignee: United Technologies Corporation, Hartford, CT (US)

( * ) Notice: Subject to any disclaimer, the term of this patent is extended or adjusted under 35 U.S.C. 154(b) by 376 days.

(21) Appl. No.: 11/480,267

(22) Filed: Jun. 30, 2006

(65) Prior Publication Data

US 2008/0003097 A1 Jan. 3, 2008

(51) Int. Cl.
*F01D 25/18* (2006.01)

(52) U.S. Cl. ..... 415/111; 415/112; 415/230

(58) Field of Classification Search ..... 415/111, 415/112, 113, 116, 230; 60/39.08; 137/489
See application file for complete search history.

(56) References Cited

U.S. PATENT DOCUMENTS 3,235,090 A * 2/1966 Bose et al. ..... 210/512.1
4,312,305 A * 1/1982 Noguchi et al. ..... 123/51 BA
6,173,735 B1 * 1/2001 Perry et al. ..... 137/489
6,330,790 B1 * 12/2001 Arora et al. ..... 60/39.08
6,991,235 B2 * 1/2006 Ebert et al. ..... 277/355

* cited by examiner

*Primary Examiner*—Ninh H Nguyen
(74) *Attorney, Agent, or Firm*—Carlson, Gaskey & Olds

(57) ABSTRACT

A turbo machine includes a housing having a bearing compartment for receiving lubrication. The housing also provides a buffer compartment for receiving air, for example, compressor bleed air. A turbine shaft is supported within the housing on a bearing for rotation relative to the housing. The bearing is arranged within the bearing compartment. A seal is arranged between the turbine shaft and the housing and separates the bearing and buffer compartments. The seal includes opposing lubrication and air sides that are respectively exposed to the bearing and buffer compartments. The buffer tube is fluidly connected to a body of the buffer compartment. A buffer tube introduces flow generally tangential to an inner surface of the body for generating a swirl within the body. The buffer tube includes a velocity control device such a venturi arranged at an exit of the tube to control the velocity of the flow entering the body. An orifice plate is arranged upstream from the venturi to control the flow to a desired flow rate. The swirling flow within the body at the desired flow rate and velocity provides a uniform pressure gradient at idle having a large enough pressure magnitude to create the desired pressure differential across the seal. The increased pressure in the buffer compartment in the vicinity of the seal prevents leakage of lubricant past the seal at idle.

12 Claims, 3 Drawing Sheets

FLOW DELIVERY SYSTEM FOR SEALS

This invention was conceived in performance of U.S. Air Force Contract No. F33657-91-C-0007. The government may have certain rights in this invention.

BACKGROUND OF THE INVENTION

This invention relates to a flow delivery system used for pressurizing seals in a turbo machine.

Turbo machines, such as a turbofan engine used in aircraft, incorporate carbon seals to separate a bearing compartment from a buffer compartment. The bearing compartment includes bearings supporting, for example, a turbine for rotation relative to a housing of the engine. The bearing compartment contains a lubricant that lubricates the bearings. The buffer compartment contains pressurized air that leaks past the seals which prevents the lubricant from weeping past the seals.

The carbon seals require a predetermined differential pressure across the seal in order to prevent leakage of lubricant past the seal. One problem is that lubrication has been known to leak past the carbon seals at idle conditions, because of an inadequate pressure differential across the seals.

The buffer compartment consists of a body which is generally cylindrical. Compressor bleed air flows into the body in a direction normal to a plane that is tangential to the body. As a result, a stagnation area forms within the body directly across from where the flow enters the body. This causes an uneven pressure distribution along the cylindrical wall of the body, and if one of the carbon seals is arranged near the cylindrical wall, the uneven pressure on the seal may result in leaks. Notwithstanding the position of the seal, the pressure in the buffer compartment is inadequate at idle.

Increased pressure is required within the buffer compartment in the vicinity of the carbon seals for the seals to be effective.

SUMMARY OF THE INVENTION

The present invention provides a turbo machine that includes a housing having a bearing compartment for receiving lubrication. The housing also provides a buffer compartment for receiving air, for example, compressor bleed air. A turbine shaft is supported within the housing on a bearing for rotation relative to the housing. The bearing is arranged within the bearing compartment. A seal is arranged between the turbine shaft and the housing and separates the bearing and buffer compartments. The seal includes opposing lubrication and air sides that are respectively exposed to the bearing and buffer compartments. A buffer tube is fluidly connected to a body of the buffer compartment. The buffer tube introduces flow generally tangential to an inner surface of the body for generating a swirl within the buffer compartment.

The buffer tube includes a velocity control device such as a venturi arranged at an exit of the tube to control the velocity of the flow entering the body. A flow control device such as an orifice plate is arranged upstream of the venturi to control the flow to a desired flow rate. The swirling flow within the body at the desired flow rate and velocity generates a uniform radial pressure gradient. At idle the radial pressure gradient results in a large enough pressure magnitude at the periphery of the buffer compartment to create the desired pressure differential across the seal. The increased pressure at the periphery prevents leakage of lubricant past the seal at idle.

These and other features of the present invention can be best understood from the following specification and drawings, the following of which is a brief description.

DETAILED DESCRIPTION OF THE PREFERRED EMBODIMENT

Figure 1:
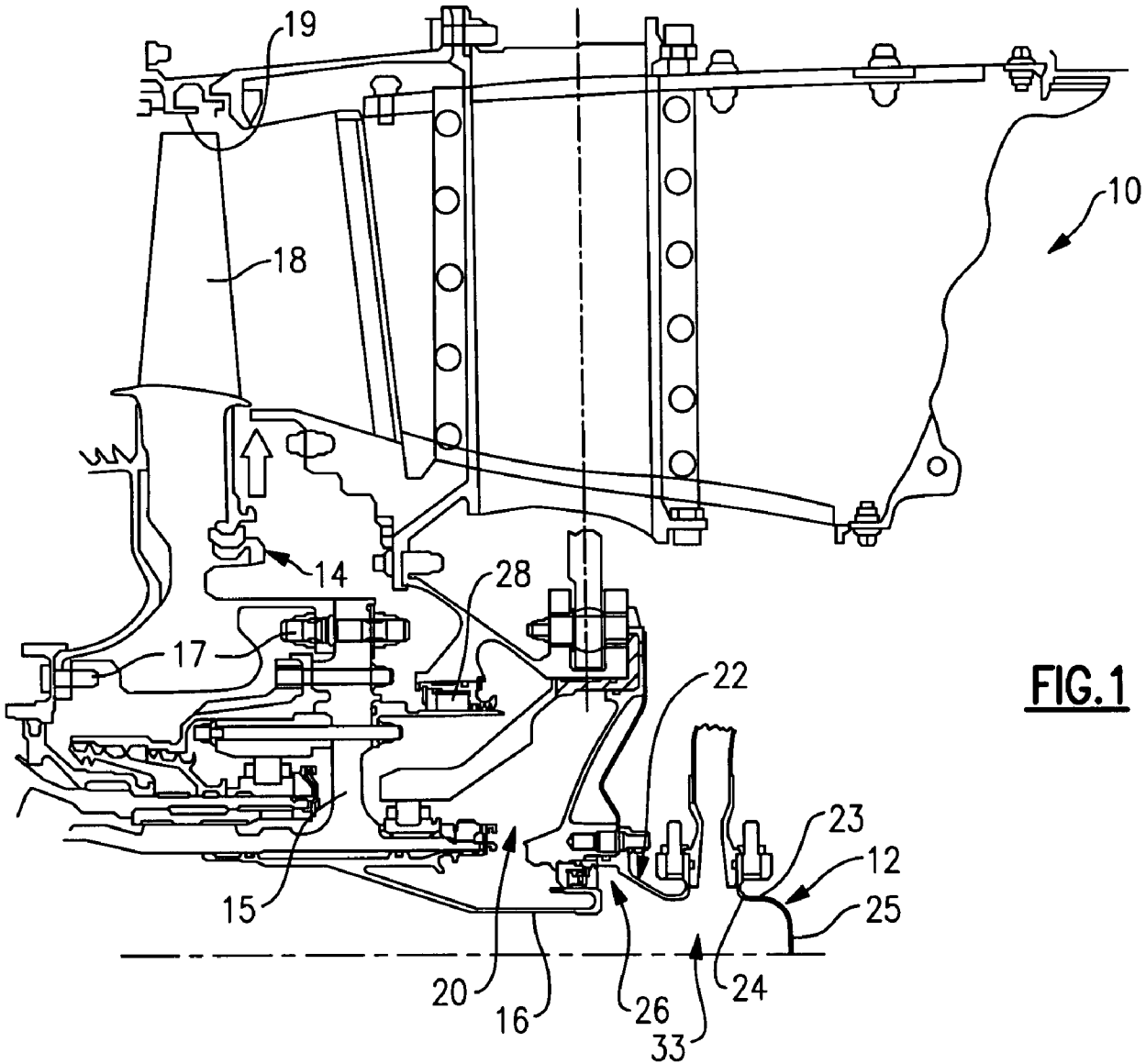
FIG. 1 is a partial, cross-sectional view of a portion of a turbofan engine.

A portion of a turbofan engine 10 is shown in FIG. 1. The engine 10 includes a housing 12 that is constructed from multiple pieces secured to one another. The housing 12 supports a turbine shaft 16 for rotation relative to the housing 12 by bearings 21, best shown in FIG. 2. The turbine shaft 16 supports a hub 15. Multiple turbine blades 18 are secured to the hub 15 by fastener 17.

The bearings 21 are arranged within a bearing compartment 20. First and second seals 26 and 28 contain the lubricant within the bearing compartment 20. An insufficient differential pressure exists across the seals, which are carbon seals in one example, so that oil can leak out of the bearing compartment 20 and collect in the housing 12 and at the bottom of the turbine flow path 19.

Figure 2:
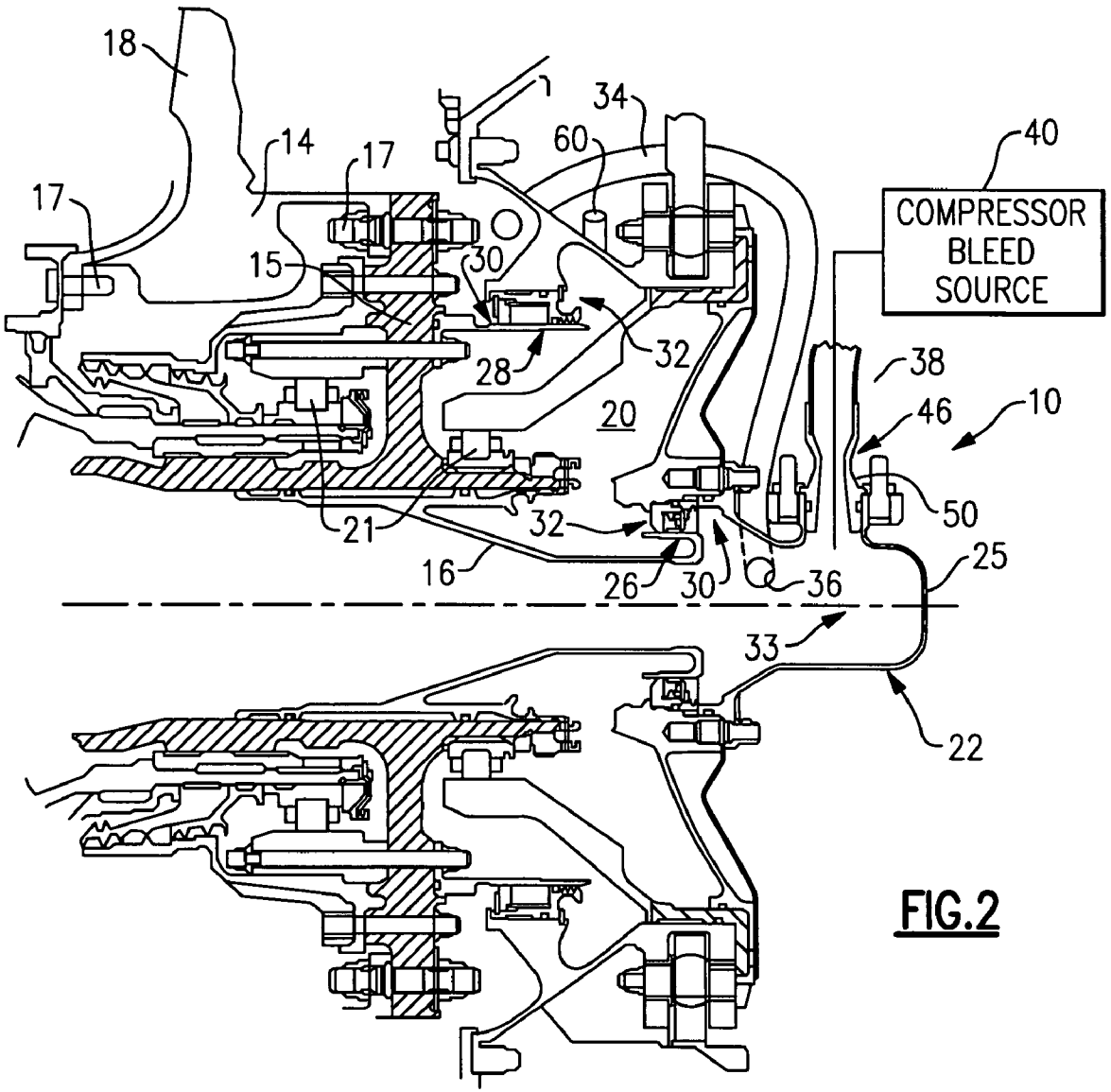
FIG. 2 is an enlarged view of a portion of the turbofan engine shown in FIG. 1.
Figure 3:
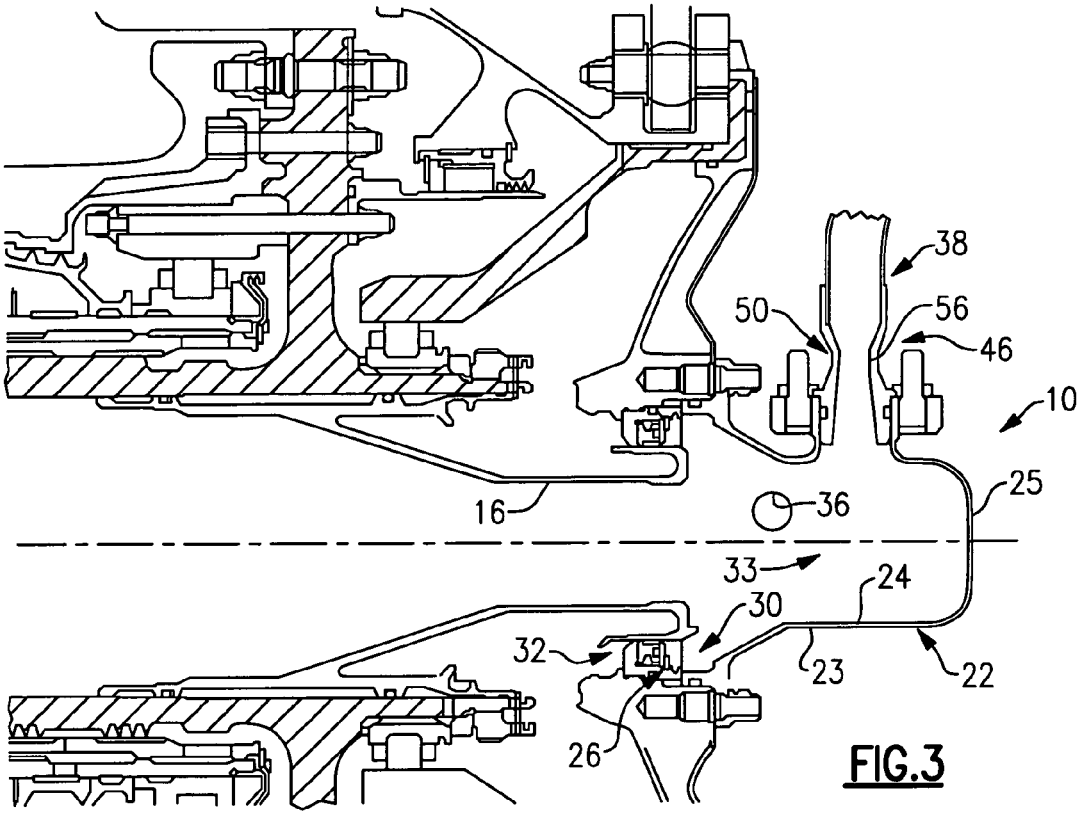
FIG. 3 is a further enlarged view of a portion of the buffer compartment in the turbofan engine shown in FIG. 2.

Referring to FIGS. 2 and 3, the housing 12 includes a cylindrical wall 23 and dome 25 that partially define a buffer compartment 33. The buffer compartment 33 provides pressurized air to an air side 30 of the first and second seals 26 and 28. The seals are effective once a predetermined differential pressure has been achieved. Inadequate pressure in the buffer compartment 33 may result in leakage past the first and second seals 26 and 28 under idle conditions.

A tube 34, schematically shown in FIG. 2, is connected to the body 22 by an inlet 36. The tube 34 carries pressurized air to a chamber on the air side 30 of the second seal 28. A buffer tube 38 supplies air to the body 22 from a compressor bleed source 40. Of course, air can be provided to the air side 30 in any suitable manner using any suitable air source. A vent 60 is shown schematically in FIG. 2 and is used to release pressure from the bearing compartment 20.

Figure 4:
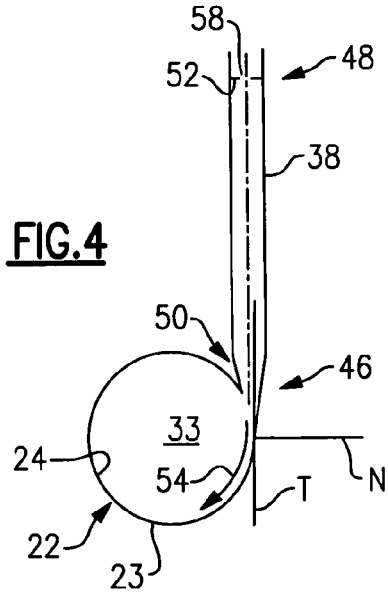
FIG. 4 is a schematic view of a tube introducing flow into a body of a buffer compartment looking parallel to an engine axis.

The present invention introduces flow 54 from an exit of the buffer tube 38 in a generally tangential plane T to an adjoining inner surface 24 of the cylindrical wall 23, as shown in FIG. 4. Introducing the flow 54 in this manner generates a swirl that promotes even pressure, as opposed to the stagnant area that would result from a flow introduced normal to the cylindrical wall 23. The normal plane N is also shown in FIG. 4. The velocity and flow rate of air from the buffer tube 38 are controlled by a velocity control device 46 and a flow control device 48. In the example shown, the velocity control device is a venturi 50 having a throat 56 arranged near where the flow from the buffer tube 38 exits into the body 22. The flow control device 48 is an orifice plate 52 arranged upstream from the venturi 50, in the example shown. The orifice plate 52 includes an orifice 58 that is sized to control the flow and, as a result, limit the velocity of flow 54 exiting the venturi 50. The relationship of the change in pressure within the body relative to the change in radial position within the body can be expressed by the following equation:

$$\frac{dP}{dr} = \frac{\rho w^2}{r}, \qquad \text{(Equation 1)}$$

where ρ is the density of the air, w is the velocity of the air exiting the venturi, and r is the radial position for which the pressure is calculated. The pressure at the seal 26 can be adjusted to a desirable magnitude by changing the velocity at which the air is introduced into the buffer compartment, or the radius at which the air is introduced. In addition, the pressure at the seal 28 can be adjusted by changing the radial position at which the supply air is extracted from the buffer compartment.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of delivering fluid to a seal comprising the steps of:

a) introducing a fluid generally tangentially to an adjoining curved surface of a body;

b) providing the fluid to a side of a seal that separates a buffer compartment having air and a bearing compartment having bearings supporting a turbine shaft with turbine blades, and c) generating a desired differential pressure across the seal subsequent to performing step b).

2. The method according to claim 1, wherein step a) includes accelerating the fluid delivered to the body.

3. The method according to claim 1, comprising the step of swirling the fluid within the body to provide a generally uniform pressure along the curved surface, subsequent to performing step a).

4. The method according to claim 1, comprising the step of controlling the flow of the fluid prior to performing step a).

5. A turbo machine comprising:

a housing including a bearing compartment for receiving lubrication, and a buffer compartment for receiving air;

a turbine shaft supported within the housing on a bearing for rotation relative to the housing, the bearing arranged in the bearing compartment;

a seal separating the bearing and buffer compartments and including opposing lubrication and air sides respectively exposed to the bearing and buffer compartments; and a buffer tube fluidly connected to a body of the buffer compartment, the buffer tube for introducing a flow generally tangential to an inner surface of the body for generating a swirl in the flow along the inner surface.

6. The turbo machine according to claim 5, wherein the seal is arranged near the inner surface.

7. The turbo machine according to claim 5, wherein a second seal is arranged between the turbine and the housing, and another tube fluidly connects the body and an air side of the second seal.

8. The turbo machine according to claim 5, wherein the turbine includes a shaft for rotation relative to the housing, the seal interconnecting the shaft and the housing.

9. The turbo machine according to claim 5, wherein the buffer tube includes a venturi for introducing a flow at a desired velocity.

10. The turbo machine according to claim 9, wherein the buffer tube includes an orifice plate for controlling the flow and limiting the flow to the venturi.

11. The turbo machine according to claim 5, wherein a compressor bleed source is fluidly connected to the buffer tube for providing the flow to the body.

12. The turbo machine according to claim 5, wherein the turbine shaft supports turbine blades.

* * * * *

UNITED STATES PATENT AND TRADEMARK OFFICE

CERTIFICATE OF CORRECTION

PATENT NO. : 7,591,631 B2
APPLICATION NO. : 11/480267
DATED : September 22, 2009
INVENTOR(S) : Hendricks et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 460 days.

Signed and Sealed this

Twenty-first Day of September, 2010

David J. Kappos

David J. Kappos
*Director of the United States Patent and Trademark Office*